United States Patent [19]

Newby

[11] 4,164,479

[45] Aug. 14, 1979

[54] METHOD FOR CALCINING NUCLEAR WASTE SOLUTIONS CONTAINING ZIRCONIUM AND HALIDES

[75] Inventor: Billie J. Newby, Idaho Falls, Id.

[73] Assignee: The United States of America as represented by the United States Department of Energy, Washington, D.C.

[21] Appl. No.: 868,953

[22] Filed: Jan. 12, 1978

[51] Int. Cl.[2] ..... G21F 9/14

[52] U.S. Cl. ..... 252/301.1 W; 423/72

[58] Field of Search ..... 252/301.1 W; 423/72, 423/116

[56] References Cited

U.S. PATENT DOCUMENTS

| | | | |
|---|---|---|---|
| 3,781,217 | 12/1973 | Newby et al. | 252/301.1 W |
| 3,943,062 | 3/1976 | Wielang et al. | 252/301.1 W |
| 3,954,661 | 5/1976 | Kilian | 252/301.1 W |

OTHER PUBLICATIONS

"Conversion of High-Level-Activity Wastes to Solids, Fluid-Bed Calcination", *Reactor Fuel Processing*, vol. 9, No. 1, (1965), pp. 42-43.

*Primary Examiner*—Benjamin R. Padgett
*Assistant Examiner*—Deborah L. Kyle
*Attorney, Agent, or Firm*—Dean E. Carlson; Frank H. Jackson; James W. Weinberger

[57] ABSTRACT

A reduction in the quantity of gelatinous solids which are formed in aqueous zirconium-fluoride nuclear reprocessing waste solutions by calcium nitrate added to suppress halide volatility during calcination of the solution while further suppressing chloride volatility is achieved by increasing the aluminum to fluoride mole ratio in the waste solution prior to adding the calcium nitrate.

6 Claims, No Drawings

METHOD FOR CALCINING NUCLEAR WASTE SOLUTIONS CONTAINING ZIRCONIUM AND HALIDES

CONTRACTUAL ORIGIN OF THE INVENTION

The invention described herein was made in the course of, or under, a contract with the United States Department of Energy.

BACKGROUND OF THE INVENTION

This invention relates to a method for suppressing halide volatility during the calcination of zirconium-fluoride nuclear reprocessing waste solutions. More particularly, this invention relates to an improvement in the present method of suppressing halide volatility of adding calcium nitrate to the solution prior to calcination.

The chemical reprocessing of spent nuclear reactor fuel elements to recover the unburned nuclear reactor fuel material generates large volumes of aqueous solutions containing radioactive wastes. In addition to the large volumes produced, the aqueous waste solutions are extremely corrosive and present difficult problems in their handling and storage. Since it is necessary to store these radioactive wastes for long periods of time to permit decay of the radioactive constituents in the waste, the aqueous wastes are converted to a solid form which not only occupies less volume than the corresponding liquid wastes, but is less corrosive and easier to handle and store. One method by which these aqueous radioactive wastes are converted to solid form is by calcining in a fluidized bed in the Waste Calcining Facility at the Idaho Chemical Processing Plant located at the United States Department of Energy's Idaho National Engineering Laboratory in southeastern Idaho. The aqueous radioactive waste solutions are transported through pipelines from makeup vessels to the Waste Calcining Facility where the aqueous solutions are sprayed into the fluidized bed through spray nozzles mounted in the walls to be calcined into a solid for storage.

The composition of nuclear reactor fuels varies depending upon the type of reactor for which the fuel is intended. So also do the waste solutions resulting from reprocessing the fuel vary in composition, each solution presenting unique problems with regard to waste disposal. For example, it is necessary to dissolve irradiated zirconium-containing fuels in hydrofluoric acid for reprocessing. The reprocessing of these fuels results in the formation of two different waste solutions for which disposal must be provided. The one solution referred to as the first-cycle zirconium fluoride waste contains in addition a trace amount of chloride in addition to aluminum and other elements and compounds. The other solution — second cycle waste — contains fluoride, chloride, sodium and aluminum along with other values and is a composite waste which also includes radioactive waste from processing other fuels, operation ICPP support facilities, plant floor drains, process equipment and non-ICPP facilities located at the Idaho National Engineering Laboratory. For purposes of disposal, the first cycle waste is calcined by itself or it may be mixed with second cycle waste at a ratio of 3 to 1 by volume to form a blend. This is done to facilitate disposal of second cycle waste which, because it contains sodium nitrate, presents special disposal problems. However, calcining releases the fluorides and chlorides present in the solutions as volatile corrosive gases which, because they are highly corrosive, are very detrimental to equipment and may be damaging to the environment should they be released.

It is known that adding calcium nitrate to the waste solutions before calcining the solutions will suppress the volatility of the fluoride to acceptable levels which can then be removed from the calciner off-gas by scrubbing equipment. However, the addition of calcium nitrate to the waste has little suppressive effect upon the chloride which, although present in the waste solutions in only relatively small amounts builds up in the fluidized bed of the calciner over a long period of operation, so that the quantity, in time, becomes significant. The addition of calcium nitrate to the waste solutions also results in the formation of a gelatinous solid. This solid, which is a hydrated calcium fluorozirconate, clogs transfer piping and calciner spray nozzles and generally disrupts calciner operation by increasing down-time for cleanup. The substitution of magnesium nitrate for calcium nitrate has been tried, and although it eliminates the formation of gelatinous solids while maintaining fluoride volatility suppression at acceptable levels, it has insufficient effect upon chloride volatility. When magnesium nitrate is added to first cycle waste, a calcine is produced which is very soft and breaks easily into fines during fluidized bed operation, plugging and bridging calciner off-gas and transport systems.

SUMMARY OF THE INVENTION

It has been found that, by adding aluminum to the waste solutions to increase the aluminum to fluoride mole ratio, before adding the calcium nitrate to the solution, the before enumerated problems are substantially reduced or eliminated.

The method of the invention therefore consists of adding aluminum to the zirconium-fluoride waste solution containing zirconium, fluoride and chloride prior to adding calcium nitrate, in an amount sufficient to establish an aluminum to fluoride mole ratio of at least 0.27, whereby the quantity of gelatinous solid formed by the subsequent addition of calcium nitrate to the solution is substantially reduced and the volatility of the chloride during calcination of the waste solution is suppressed. It is further the method of the invention of adding aluminum to a blend of 3 parts zirconium-fluoride waste and 1 part second cycle waste prior to adding calcium nitrate, in an amount sufficient to establish an aluminum to fluoride mole ratio of 0.32, thereby reducing gelatinous solids formation and chloride volatility during calcination of the blend.

It is therefore one object of the invention to provide an improvement in the method for calcining aqueous nuclear fuel reprocessing waste solutions containing zirconium, fluoride and chloride.

It is a further object of the invention to provide an improvement in the method for suppressing the volatility of fluoride and chloride during the calcination of zirconium-fluoride nuclear fuel reprocessing wastes containing zirconium, fluoride and chloride in which calcium nitrate is added to the solution before calcination.

Finally, it is the object of the invention to provide an improved method for suppressing the volatility of fluoride and chloride during the calcination of the blend nuclear fuel reprocessing wastes consisting of zirconium fluoride wastes and second cycle wastes and containing zirconium, fluoride and chloride while reducing the amount of gelatinous solids formed in the wastes by the addition of calcium nitrate to the blend before calcination.

DESCRIPTION OF THE PREFERRED EMBODIMENT

These and other objects of the invention for an improvement in the method of suppressing fluoride and chloride volatility during the calcination of aqueous nuclear fuel reprocessing solutions containing zirconium fluoride, chloride and other values by adding calcium nitrate to the solution in an amount sufficient to establish a calcium to fluoride mole ratio of at least 0.55 wherein the calcium nitrate acts to suppress fluoride volatility during calcination, the improvement wherein aluminum nitrate is added to the solution before the calcium nitrate in an amount sufficient to make the aluminum to fluoride mole ratio from about 0.27 to 0.40, whereby the formation of gelatinous solids in the waste due to the presence of calcium nitrate is substantially reduced and the volatility of the chloride during calcination of the solution is suppressed.

This invention is particularly suited for suppressing fluoride and chloride volatility while reducing the gelatinous solids formed by the addition of calcium nitrate to aqueous waste solutions such as the first cycle zirconium-fluoride waste resulting from the reprocessing of zirconium fuels at the Idaho Chemical Processing Plant (ICPP) and to the blend of first cycle waste with second cycle waste from zirconium fuel reprocessing. It is also suitable for improving the calcinability of any aqueous solution containing zirconium, fluoride and chloride compounds.

In Table I below are given the nominal compositions of the two waste solutions.

TABLE I

COMPOSITION OF WASTES

| Constituent | Concentrations: 1st Cycle Zirconium-Fluoride Waste | | 2nd Cycle Waste | |
|---|---|---|---|---|
| $H^+$ | 2.3 | M | 1.3 | M |
| Zr | 0.38 | M | | |
| Al | 0.64 | M | 0.66 | M |
| Cr | 1.6 | g/l | | |
| Sn | 0.39 | g/l | | |
| B | 1.7 | g/l | 0.14 | g/l |
| Na | | | 59.5 | g/l |
| K | | | 9.6 | g/l |
| Fe | | | 1.2 | g/l |
| Mn | | | 1350 | ppm |
| NH | | | 0.035 | M |
| $Hg^4$ | | | 0.99 | g/l |
| $NO_3^-$ | 2.8 | M | 6.0 | M |
| $F^-$ | 3.0 | M | 0.0065 | M |
| $PO_4^{-3}$ | | | 2.7 | g/l |
| $SO_4^{-2}$ | | | 0.063 | M |
| Cl | trace | | 1700 | ppm |

Calcium nitrate is added to the first cycle zirconium-fluoride waste solution in an amount sufficient to make the calcium to fluoride mole ratio at least 0.55 to provide adequate suppression of the fluoride volatility. Although this is sufficient for first cycle waste, a mole ratio of at least 0.6, preferably 0.7, is necessary when the blend of wastes is calcined. This is required to prevent nodules forming on the fluidized-bed material and ultimately causing a collapsed bed. These nodules are believed to be due to sodium in the second cycle waste.

It will be noted in Table I, that both waste solutions contain aluminum, the first cycle waste having a normal aluminum to fluoride mole ratio of about 0.21 while the blend has a ratio of about 0.28. The amount of aluminum to be added to first cycle waste must be an amount sufficient to establish a mole ratio of aluminum to fluoride from about 0.27 to about 0.40. Although the 0.27 ratio is preferred, increased aluminum content was found to have no deleterious effects. Although the blend of first cycle and second cycle wastes, contains sufficient aluminum to establish an aluminum to fluoride mole ratio of 0.28, this is insufficient to provide adequate chloride volatility suppression for reasons unknown. However, when sufficient aluminum is added to establish an aluminum to fluoride mole ratio from about 0.32 to about 0.4, with 0.32 being preferred, the volatility of the chloride present in the blend was substantially reduced.

The calcium and aluminum are generally added to the waste solutions as nitrates because of solubility and compatibility with the compounds already present, although any compound, which is soluble in the solution and compatible with the ions already present, would be suitable.

The reasons for the effect of the increased aluminum to fluoride ratio on reducing the amount of gelatinous solids formed by the addition of calcium nitrate and on the suppression of chloride volatility are unknown.

The following examples are given to show the operability of the method of the invention and are not to be taken as limiting the scope of the invention as defined by the claims appended hereto.

EXAMPLE I

To demonstrate the effect of the addition of calcium and aluminum on the amount of gelatinous solids formed in the first cycle waste and in the blend, experiments were run in which varying amounts of ions were added to the wastes. In Table II the rate of filtration of solids after calcium nitrate or aluminum nitrate plus calcium nitrate had been added to the wastes is used as a measure of the gelatinous nature of the residue — the less the filtering time, the less the gelatinous nature of the solid. In each case 30 ml of homogenized slurry is sucked through a sintered glass filter (that has never been used before) having a 14 micron porosity by a vacuum pressure of 17 inches of mercury. The results are given in Table II below.

TABLE II

Effect of Calcium and Aluminum Concentrations On The Gelatinous Nature And Amount Of Solids Formed In Zirconium And Fluoride-Containing Wastes

| Waste | Ca to F Mole Ratio | Al to F Mole Ratio | Filtering Time | Residue (g from 30 ml waste) |
|---|---|---|---|---|
| 1st Cycle Zr-F Waste | 0.55 | 0.21 | 25 min | 4.6 |
| 1st Cycle Zr-F Waste | 0.55 | 0.27 | 5 min 10 sec | 2.6 |
| 1st Cycle Zr-F Waste | 0.55 | 0.40 | 1 min 5 sec | 0.55 |
| 3 Vol 1st Cycle Zr-F Waste blended with 1 vol 2nd Cycle Waste | 0.7 | 0.28 | 3 min | 2.4 |
| 3 Vol 1st Cycle Zr-F Waste Blend with 1 vol | 0.7 | 0.32 | 45 sec | 0.52 |

TABLE II-continued

Effect of Calcium and Aluminum Concentrations On The Gelatinous Nature And Amount Of Solids Formed In Zirconium And Fluoride-Containing Wastes

| Waste | Ca to F Mole Ratio | Al to F Mole Ratio | Filtering Time | Residue (g from 30 ml waste) |
|---|---|---|---|---|
| 2nd Cycle Waste | | | | |

It can be seen that the addition of a small amount of aluminum resulted in a substantial reduction of the amount of solids formed.

EXAMPLE II

The method for decreasing gelatinous solids in calciner feed was tested by runs in a 4-inch diameter, fluidized-bed, in-bed combustion, pilot plant calciner to determine how the methods affected fluoride and chloride volatility, calciner operability, and calcine properties in such a calciner. Table III shows that increasing the aluminum to fluoride mole ratio in first-cycle zirconium-fluoride waste from 0.21 to 0.40 prior to $Ca(NO_3)_2$ addition had no adverse effect on fluoride volatility, calciner operability, and calcine properties. The attrition index is a measure of the hardness of bed particles — the smaller the index, the softer the particles. Table III also shows that the use of $Mg(NO_3)_2$ produces a bed particle that is probably too soft; a soft bed particle breaks easily into fines during fluidized-bed operation, and the production of too many fines would likely result in plugging and bridging in the calciner off-gas and transport systems. Thus, the use of $Mg(NO_3)_2$ is not recommended for use in the calcination of first-cycle zirconium-fluoride waste. Table IV shows that increasing the aluminum to fluoride mole ratio from 0.28 to 0.32 in a blend of three volumes of first-cycle zirconium fluoride waste with one volume of second-cycle waste prior to calcium nitrate addition reduced chloride volatility, suppressed fluoride volatility satisfactorily, resulted in smooth calciner operation and produced a calcine of acceptable properties.

TABLE III

Calcination Of First-Cycle Zirconium-Fluoride Waste In A 4-Inch Diameter, Fluidized-Bed, In-Bed Combustion Calciner

| Run # | FV4-lb | FV4-2 | FV4-3 |
|---|---|---|---|
| Run Duration (Hrs.) | 58.7 | 40 | 40 |
| Ca/F Mole Ratio | 0.55 | 0.55 | 0 |
| Mg/f Mole Ratio | 0 | 0 | 0.55 |
| Al/F Mole Ratio | 0.21 | 0.40 | 0.21 |
| Wt % Volatilized from Calciner | 0.6 | 0.1 | 0.2 |
| Calcination Temp. (°C.) | 500 | 500 | 500 |
| Product to Fines Ratio | 2.76 | 2.01 | 1.66 |
| Density of Product (g/cc) | 1.22 | 1.21 | 1.15 |
| Density of Fines 11 (g/cc) | 0.54 | 0.77 | 0.57 |
| Attrition Index of the Final Bed (of the −32 +35 Mesh Fraction) (%) | 28 | 16 | 4 |
| Calciner Operability | No problems | No problems | No problems |

TABLE IV

Calcination Of A Blend Of 3 Volumes First-Cycle Zirconium-Fluoride Waste With 1 Volume Second-Cycle Waste In Fluidized-Bed, In-Bed Combustion Calciner

| Run # | 53 | FV4-4 | SBW 4-9 |
|---|---|---|---|
| Run Duration (Hrs.) | 131 | 72 | 40 |
| Calcination Temp. (.°C.) | 500 | 500 | 500 |
| Ca/F Mole Ratio | 0.7 | 0.7 | 0.7 |
| Al/F Mole Ratio | 0.28 | 0.32 | 0.32 |
| Wt % F Volatilized from Calciner | (a) | 0.2 | 0.7 |
| Wt % Cl Retained in Bed Plus Fines | 70 | 92 | 92 |
| Product to Fines Ratio | (a) | 2.77 | 5.6 |
| Density of Product (g/cc) | (a) | 1.58 | 1.68 |
| Density of Fines (g/cc) | 0.49 | 0.46 | 0.65 |
| Attrition Index of the Final Bed (of the −32 +35 Mesh Fraction) (%) | 68 | 76 | 80 |
| Calciner Operability | No problems | No problems | No problems |
| Texture of calcine surface | Smooth | Smooth | Smooth |

Run 53 was made in a 12 inch diameter fluidized bed, in-bed combustion calciner Run FV4-4, SBW 4-9 - were made 4 inch diameter fluidized bed, in bed combustion calciner.

As can be seen from the preceding discussion and Examples, the addition of aluminum to the zirconium-fluoride waste and in the blend prior to adding calcium nitrate, not only reduces the volume of gelatinous solids formed by the calcium nitrate but also substantially decreases the volatility of the chloride in the blend. Reducing chloride volatility helps not only to reduce equipment corrosion but also reduces the possibility of corrosive gases escaping into and polluting the environment. Reducing volume of gelatinous solids reduces the potential for plugging the feed system to a calciner.

The embodiments of the invention in which an exclusive property or privilege is claimed are defined as follows:

1. In the method of solidifying aqueous nuclear fuel reprocessing waste solutions containing zirconium, fluoride and chloride for long-term storage by adding calcium nitrate to the solution in an amount sufficient to establish a calcium to fluoride mole ratio of at least 0.55, and heating the resulting solution to calcining temperature, thereby calcining the waste solution to form a calcine, the calcium nitrate being present to suppress the volatility of the fluoride during calcination, the improvement wherein aluminum is added to the waste solution before the addition of calcium nitrate, the aluminum being added as a soluble, compatible compound in an amount sufficient to establish an aluminum to fluoride mole ratio of from 0.27 to 0.40 whereby the aluminum reduces the amount of gelatinous solid formed in the solution due to the presence of calcium nitrate and suppresses the volatility of the chloride during calcination of the waste solution.

2. The method of claim 1 wherein the aluminum is added as aluminum nitrate.

3. The method of claim 2 wherein the aluminum to fluoride mole ratio is 0.27.

4. The method of claim 1 wherein the waste solution containing zirconium, fluoride and chloride is a zirconium-fluoride waste solution and is present in a blend in a ratio of 3 parts zirconium-fluoride waste solution with 1 part second cycle waste, the calcium nitrate added to the blend is an amount sufficient to establish a calcium to fluoride mole ratio of from 0.6 to 0.7 and the aluminum is added in an amount sufficient to establish an aluminum to fluoride mole ratio of from 0.32 to 0.4.

5. The method of claim 4 wherein the aluminum is added as aluminum nitrate.

6. The method of claim 5 wherein the aluminum to fluoride mole ratio is 0.32.

* * * * *